US012390080B2

(12) United States Patent
Farris

(10) Patent No.: US 12,390,080 B2
(45) Date of Patent: Aug. 19, 2025

(54) DISHWASHING APPLIANCES AND FLUID-LOSS MITIGATION

(71) Applicant: Haier US Appliance Solutions, Inc., Wilmington, DE (US)

(72) Inventor: Brett Alan Farris, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 86 days.

(21) Appl. No.: 18/480,103

(22) Filed: Oct. 3, 2023

(65) Prior Publication Data

US 2025/0107684 A1 Apr. 3, 2025

(51) Int. Cl.
*A47L 15/16* (2006.01)
*A47L 15/42* (2006.01)

(52) U.S. Cl.
CPC ..... *A47L 15/4212* (2013.01); *A47L 15/16* (2013.01); *A47L 2401/06* (2013.01); *A47L 2401/14* (2013.01); *A47L 2501/01* (2013.01); *A47L 2501/26* (2013.01)

(58) Field of Classification Search
CPC ..... A47L 15/16
See application file for complete search history.

(56) References Cited

U.S. PATENT DOCUMENTS

| | | | |
|---|---|---|---|
| 10,624,521 | B2 | 4/2020 | Durham |
| 10,874,281 | B2 | 12/2020 | Durham et al. |

FOREIGN PATENT DOCUMENTS

| | | | |
|---|---|---|---|
| CN | 202837868 | U | 3/2013 |
| CN | 113069063 | A | 7/2021 |
| CN | 214965255 | U | 12/2021 |
| EP | 2886702 | B1 | 2/2017 |
| EP | 3650828 | B1 | 10/2022 |
| WO | WO2012103981 | A2 | 6/2013 |

*Primary Examiner* — Jason Y Ko
(74) *Attorney, Agent, or Firm* — Dority & Manning, P.A.

(57) ABSTRACT

A wash or dishwashing appliance may include a cabinet, a tub, a door, a fluid pump, a controller, a low-power input sensor, and a conditioning circuit. The controller may be configured to alternate between an active operational mode and a standby mode. The low-power input sensor may be configured to detect a fluid-loss event at the dishwashing appliance at the standby mode of the controller and transmit a fluid-loss signal in response to detecting the fluid-loss event. The conditioning circuit may be attached to the cabinet in electrical communication with the low-power input sensor and separate from the controller. The conditioning circuit may be configured to receive the fluid-loss signal apart from the controller at the standby mode and initiate a mitigation action in response to receiving the fluid-loss signal.

20 Claims, 7 Drawing Sheets

DISHWASHING APPLIANCES AND FLUID-LOSS MITIGATION

FIELD OF THE DISCLOSURE

The present subject matter relates generally to dishwashing appliances, and more particularly to features for addressing potential fluid-loss of a dishwashing appliance.

BACKGROUND OF THE DISCLOSURE

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash fluid (e.g., water, detergent, etc.) towards articles disposed within the rack assemblies in order to clean such articles. Dishwashing appliances are also typically equipped with one or more pumps, such as a circulation pump or a drain pump, for directing or motivating wash fluid from the wash chamber (e.g., to the spray assemblies or an area outside of the dishwashing appliance).

Conventional dishwashing appliances often include one or more pressure sensors to detect water pressure within the dishwashing appliance (e.g., during a wash cycle). In particular, such pressure sensors may be provided to detected elevated pressure states, which may indicate a clog or some other issue within the wash chamber is causing the dishwashing appliance to be at risk of flooding. As a way of addressing such concerns, typical dishwashing appliances are configured to stop a washing operation or wash cycle as soon as an excessive pressure is detected.

It is notable that fluid-loss events, such as flooding or leaks, may occur outside of an active cycle or operation. Although existing systems may be useful to detect or mitigate flooding during the course of a wash cycle or operation, they may not be suitable for detecting or mitigating flooding or leaks outside of an active cycle or operation. In particular, existing systems typically require a main controller; which controls the user interface, pumps, and general wash cycle execution; to be fully powered. Attempts to use such systems continuously (e.g., even when a cycle is not being performed) can significantly impact the power use of the appliance, and thus increase the cost of owning and operating the appliance.

As a result, it may be useful to provide a system or assembly capable of addressing potential fluid-loss events outside of an active cycle or operation. In particular, it would be advantageous to provide a low-power system or assembly for continuously addressing potential fluid-loss events.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a cabinet, a tub, a door, a spray assembly, a fluid pump, a controller, a low-power input sensor, and a conditioning circuit. The tub may be positioned within the cabinet and define a wash chamber for receipt of articles for washing. The door may be mounted to the cabinet to selectively restrict access to the tub. The spray assembly may be positioned within the wash chamber. The fluid pump may be in fluid communication with the wash chamber. The controller may be configured to alternate between an active operational mode and a standby mode in which a power draw at the controller is less than a power draw of the active operational mode. The low-power input sensor may be configured to detect a fluid-loss event at the dishwashing appliance at the standby mode of the controller and transmit a fluid-loss signal in response to detecting the fluid-loss event. The conditioning circuit may be attached to the cabinet in electrical communication with the low-power input sensor and separate from the controller. The conditioning circuit may be configured to receive the fluid-loss signal apart from the controller at the standby mode and initiate a mitigation action in response to receiving the fluid-loss signal.

In another exemplary aspect of the present disclosure, a wash appliance is provided. The wash appliance may include a cabinet, a tub, a door, a fluid pump, a controller, a low-power input sensor, and a conditioning circuit. The tub may be positioned within the cabinet and define a wash chamber for receipt of articles for washing. The door may be mounted to the cabinet to selectively restrict access to the tub. The fluid pump may be in fluid communication with the wash chamber. The fluid pump may be a drain pump mounted within the cabinet downstream from the wash chamber. The controller may be configured to alternate between an active operational mode and a standby mode in which a power draw at the controller is less than a power draw of the active operational mode. The low-power input sensor may be configured to detect a fluid-loss event at the wash appliance at the standby mode of the controller and transmit a fluid-loss signal in response to detecting the fluid-loss event. The conditioning circuit may be attached to the cabinet in electrical communication with the low-power input sensor and the controller. The conditioning circuit may be configured to receive the fluid-loss signal apart from the controller at the standby mode and initiate a mitigation action in response to receiving the fluid-loss signal. The mitigation action may include directing activation of a water-flow component within the cabinet apart from the controller.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
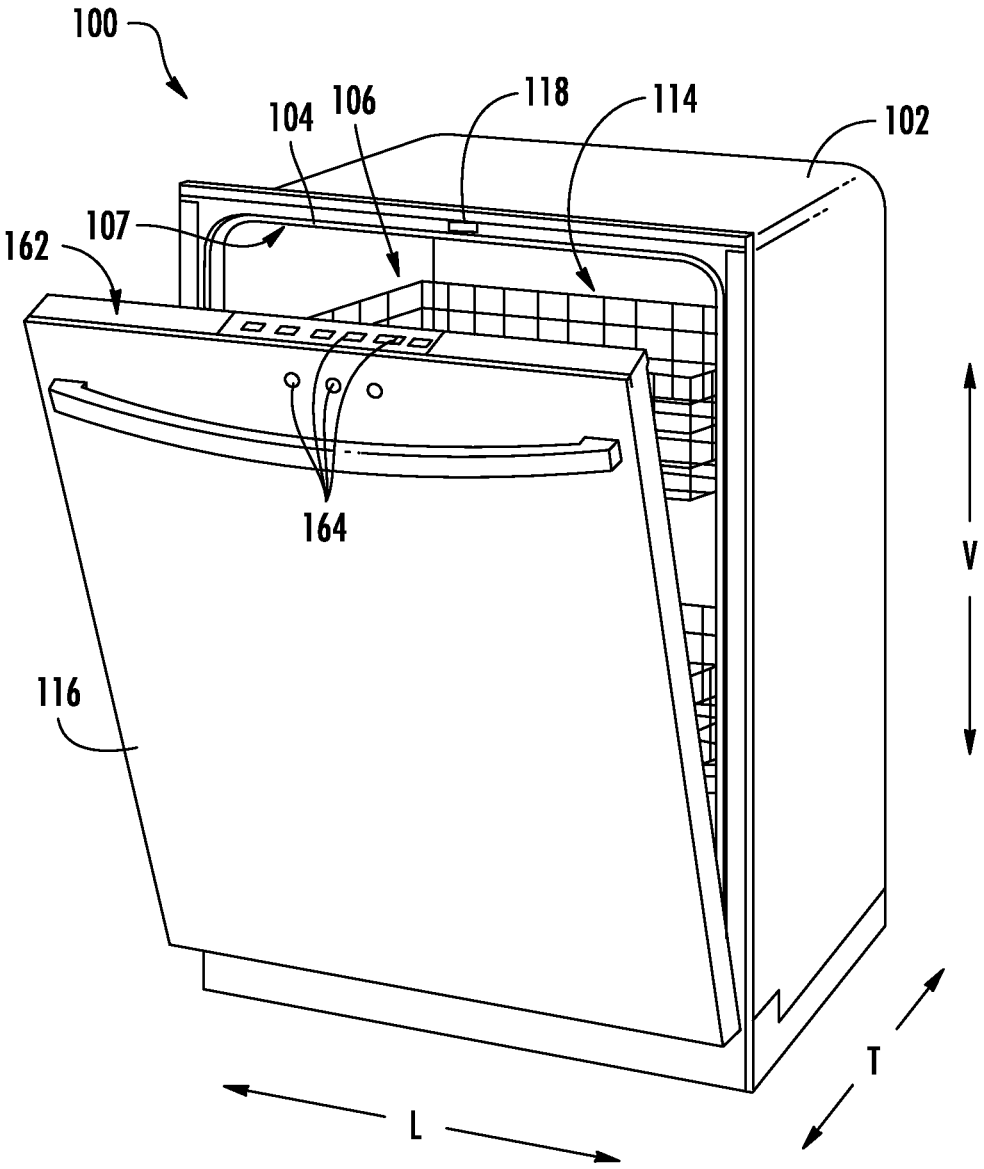
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash fluid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing or rinsing the articles that is typically made up of water and may include additives, such as detergent or other treatments (e.g., rinse aid).

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Figure 2:
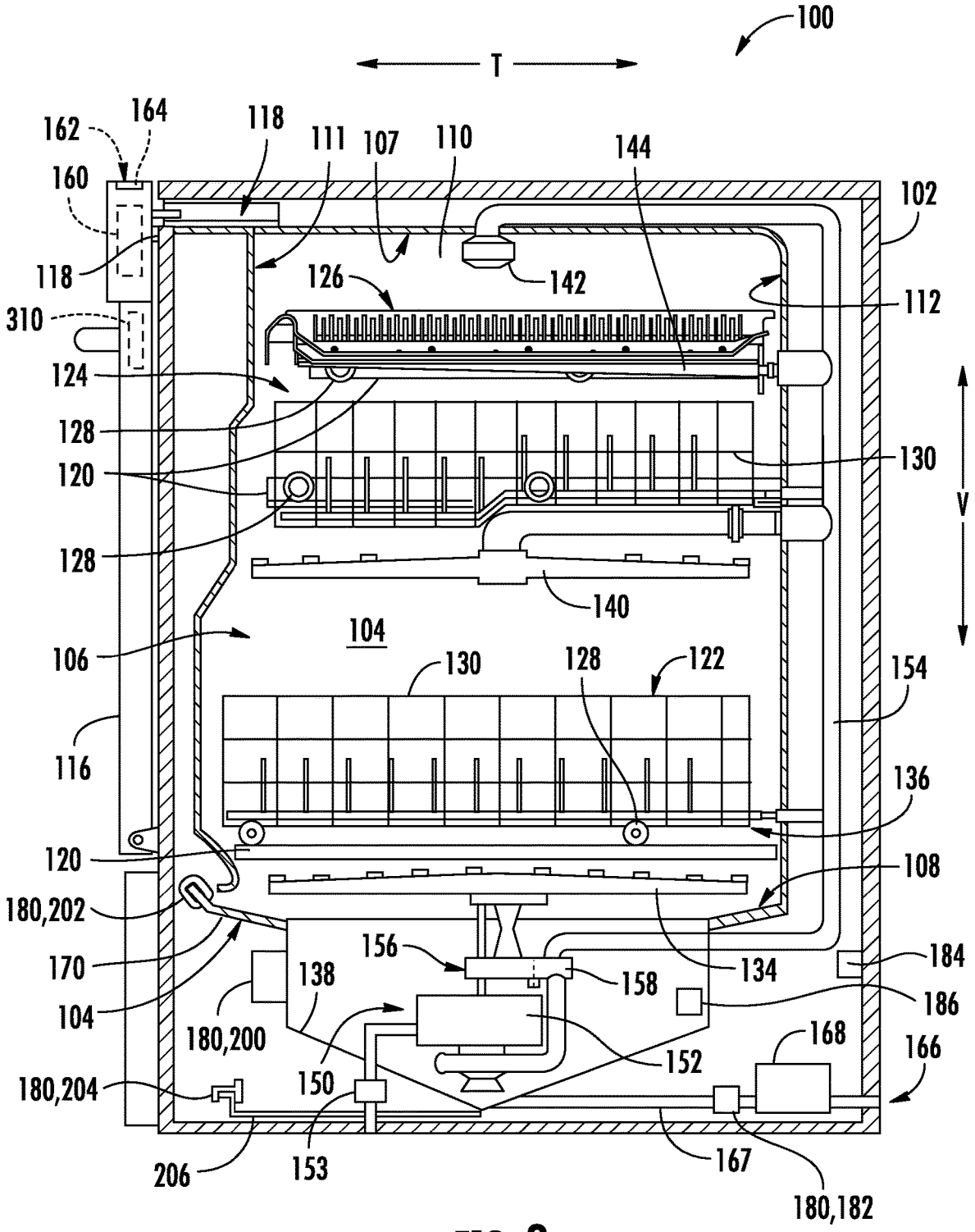
FIG. 2 provides a side, cross sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 (FIG. 1) and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. Dishwasher 100 includes a door closure mechanism or assembly 118 that is used to lock and unlock door 116 for accessing and sealing wash chamber 106.

As further shown in FIG. 2, tub side walls 110 accommodate a plurality of rack assemblies. More specifically, guide rails 120 are mounted to side walls 110 for supporting a lower rack assembly 122, a middle rack assembly 124, and an upper rack assembly 126. Upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to other exemplary embodiments, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 is generally configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in tub 104. More specifically, fluid circulation assembly 150 includes one or more fluid pumps (e.g., a circulation pump 152) for circulating water and wash fluid (e.g., detergent, water, or rinse aid) in tub 104. Circulation pump 152 is located within sump 138 or within a machinery compartment located below sump 138 of tub 104. Circulation pump 152 may be in fluid communication with an external water supply line (not shown) and sump 138. A water inlet valve 153 can be positioned between the external water supply line and circulation pump 152 to selectively allow water to flow from the external water supply line to circulation pump 152. Additionally or alternatively, water inlet valve 153 can be positioned between the external water supply line and sump 138 to selectively allow water to flow from the external water supply line to sump 138. Water inlet valve 153 can be selectively controlled to open to allow the flow of water into dishwasher 100 and can be selectively controlled to cease the flow of water into dishwasher 100. Further, fluid circulation assembly 150 may include one or more fluid conduits or circulation piping for directing water or wash fluid from circulation pump 152 to the various spray assemblies and manifolds. For example, for the embodiment depicted in FIG. 2, a primary supply conduit 154 extends from circulation pump 152, along rear 112 of tub 104 along the vertical direction V to supply wash fluid throughout wash chamber 106.

As further illustrated in FIG. 2, primary supply conduit 154 is used to supply wash fluid to one or more spray assemblies, such as to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

In operation, circulation pump 152 may draw wash fluid in from sump 138 and pump it to a diverter 156 (e.g., positioned within sump 138 of dishwasher appliance). Diverter 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter 156 is configured for selectively distributing the flow of wash fluid from circulation pump 152 to various fluid supply conduits, only some of which are illustrated in FIG. 2 for clarity. More specifically, diverter 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., primary supply conduit 154).

Drainage of soiled water within sump 138 may occur, for example, through drain assembly 166, which may include one or more fluid pumps (e.g., including or in addition to circulation pump 152). In particular, water may exit sump through a drain and may flow through a drain conduit 167. In some embodiments, a fluid pump (e.g., drain pump 168) may facilitate drainage of the soiled water by pumping the water to a drain line external to the dishwasher 100.

Dishwasher 100 is further equipped with a controller (e.g., main controller) 160 to regulate general operation of dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 160 may be positioned in a variety of locations throughout dishwasher 100. In the illustrated embodiment, controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116.

a controller configured to alternate between an active operational mode and a standby mode in which a power draw at the controller is less than a power draw of the active operational mode;

Typically, the controller 160 includes a user interface panel/controls 164 through which a user may select various operational features and modes and monitor progress of dishwasher 100. In one embodiment, the user interface panel 164 may represent a general purpose I/O ("GPIO") device or functional block. In one embodiment, the user interface panel 164 may include input components, such as one or more of a variety of electrical, mechanical or electromechanical input devices including rotary dials, push buttons, and touch pads. The user interface panel 164 may include a display component, such as a digital or analog display device designed to provide operational feedback to a user. The user interface panel 164 may be in communication with the controller 160 via one or more signal lines or shared communication busses. Optionally, a user interface or display of a remote device (e.g., separate computer, tablet, smartphone, wearable electronic device, etc.) may be in wireless operative communication with the controller 160, such that data or signals (e.g., relating to the status or operation of dishwasher 100) may be exchanged therebetween (e.g., using a dedicated program or application running on the remote device), as would be understood in light of the present disclosure.

It may be notable that the controller 160 is configured to alternate or switch between two or more discrete operational modes (e.g., influencing the power draw, functional capabilities, or communication to various portions of the controller 160 or the appliance 100 in general). For instance, controller 160 may include an active operational mode and a standby mode that is separate or distinct from the active operational mode. Each of the active and standby operational modes may be configured to have a discrete power draw (e.g., limit or maximum). Thus, the active operational mode may have a first power draw and the standby operational mode may have a second power draw that is less than first power draw. The active operational mode may, moreover, correspond to standard or active operation of the dishwasher 100 (e.g., during a wash cycle or while receiving input signals from the user interface 164). By contrast, the standby operational mode may correspond to an inactive or relatively low-power state of the dishwasher 100 (e.g., in comparison to the active operational mode). In turn, various components or portions of the controller 160 (e.g., the processor) may be set to power down in the standby operational mode (e.g., as controlled by a power latch circuit 312 configured or mounted along a circuit to open or otherwise restrict flow of an electrical circuit to the controller 160). Optionally, in the standby operational mode, various components that are connected to or controlled by the controller 160 (e.g., one or more fluid pumps 320, user interface panel 164, water valve 153, etc.) may be inactive or powered down in the standby operational mode (e.g., by the nature of the connection to the controller 160, which may be configured to supply or control power to such components).

Separate from controller 160, a conditioning circuit 310 may be attached to cabinet 102 (e.g., directly or, alternatively, indirectly, such as via the door 116) in electrical communication with the controller 160. For instance, the conditioning circuit 310 may be mounted on or within the door 116. Generally, and as will be described in greater detail below, conditioning circuit 310 may be provided as part of a larger operational assembly 300 for selectively powering or directing operations at various components of dishwasher 100 (e.g., independently of or in tandem with controller 160).

In some embodiments, one or more low-power input sensors 316 are provided on or within dishwasher 100. Such low-power sensor(s) 316 may be configured to detect a fluid-loss event at the dishwasher 100 (e.g., directly or indirectly, such as inferentially). Generally, such a low-power input sensor 316 may be provided as an suitable electronic sensor configured to detect at least one condition at the dishwasher 100 that is predetermined to correspond to a fluid-loss (i.e., conditions likely to indicate a fluid-loss event or failure, generally) and transmit a fluid-loss signal (e.g., voltage or halting of a voltage) in response to such a detection.

As an example, the low-power input sensor 316 may include or be provided as a positional sensor 184, such as an accelerometer or gyroscope fixed to cabinet 102 or another suitable portion of dishwasher 100 to detect movement at a portion of the dishwasher 100 and a fluid-loss signal corresponding to such detection or movement.

As an additional or alternative example, the low-power input sensor 316 may include or be provided as a temperature sensor 186, such as a thermistor, thermocouple, or bimetallic switch attached to cabinet 102 and configured to detect a temperature below or above one more set temperature thresholds and transmit a fluid-loss signal or voltage corresponding to such detection or temperature(s).

As another additional or alternative example, the low-power input sensor 316 may include or be provided as a water sensor 180 configured to detect water or wash fluid (e.g., the general presence or attribute thereof) within the cabinet 102 and transmit a fluid-loss signal corresponding to such a detection or water. For instance, the water sensor 180 may include a continuity sensor (e.g., tub lip sensor 202 or leak pan sensor 204), pressure sensor (e.g., pressure sensor 200), or flowmeter 182 (e.g., orifice flowmeter, differential pressure meter, magnetic flowmeter, venturi flowmeter, pitot tube flowmeter, positive displacement flowmeter, volumetric flowmeter, turbine flowmeter, etc., any of which may be mounted along drain conduit 167 or a conduit connecting water valve 153). At or beyond a predetermined threshold condition of the water sensor, the continuity sensor, pressure sensor, or flowmeter may be configured to transmit a corresponding fluid-loss signal to the conditioning circuit 310.

It should be appreciated that the present disclosure is not limited to any particular style, model, or configuration of dishwasher. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present disclosure. Moreover, it should further be appreciated that, except as otherwise indicated, the present disclosure is not limited to any particular wash appliance. For instance, it would be understood that the present disclosure may be applicable to any suitable wash or dishwashing appliance. As an example, certain aspect of the above disclosure may be appliance to a washing machine appliance for cleaning clothing articles, as is generally understood.

With reference still to FIG. 2, dishwasher 100 may experience a fluid-loss event that includes or is provided as a tub overfill (e.g., flood) event, such as when wash fluid floods over a tub lip 170 of tub 104. Such an overfill or flood event can occur as a result of any number of conditions or failures, such as, for example, a clog at one or points of the circulation or drain assemblies, an out-of-level condition, a valve failure, or a fluid pump failure. As noted above, one or more low-power input sensor 316 may provide feedback (e.g., to controller 160 or a conditioning circuit 310) such that corrective action may be taken. In some embodiments, dishwasher 100 includes a pressure sensor 200 positioned on or mounted to sump 138. Pressure sensor 200 may be configured to detect a liquid level within sump 138 or tub 104. In additional or alternative embodiments, dishwasher 100 includes a tub lip sensor 202 positioned on or mounted to tub lip 170. Tub lip sensor 202 may be configured to detect wash fluid at or proximate tub lip 170.

Further, in some instances, dishwasher 100 may experience a fluid-loss event that includes or is provided as a direct leak. In such instances, wash fluid may leak from tub 104, sump 138, or another component of dishwasher 100. To prevent leaking wash fluid from spilling onto or pooling on a consumer's floor, for this embodiment, dishwasher 100 includes a leak pan 206 positioned below sump 138 and tub 104 along the vertical direction V. Leak pan 206 may be configured to collect leaking wash fluid. In addition, as shown in FIG. 2, dishwasher 100 includes a leak pan sensor 204 positioned on or mounted to leak pan 206. Leak pan sensor 204 may be configured to detect wash fluid in leak pan 206.

Figure 3:
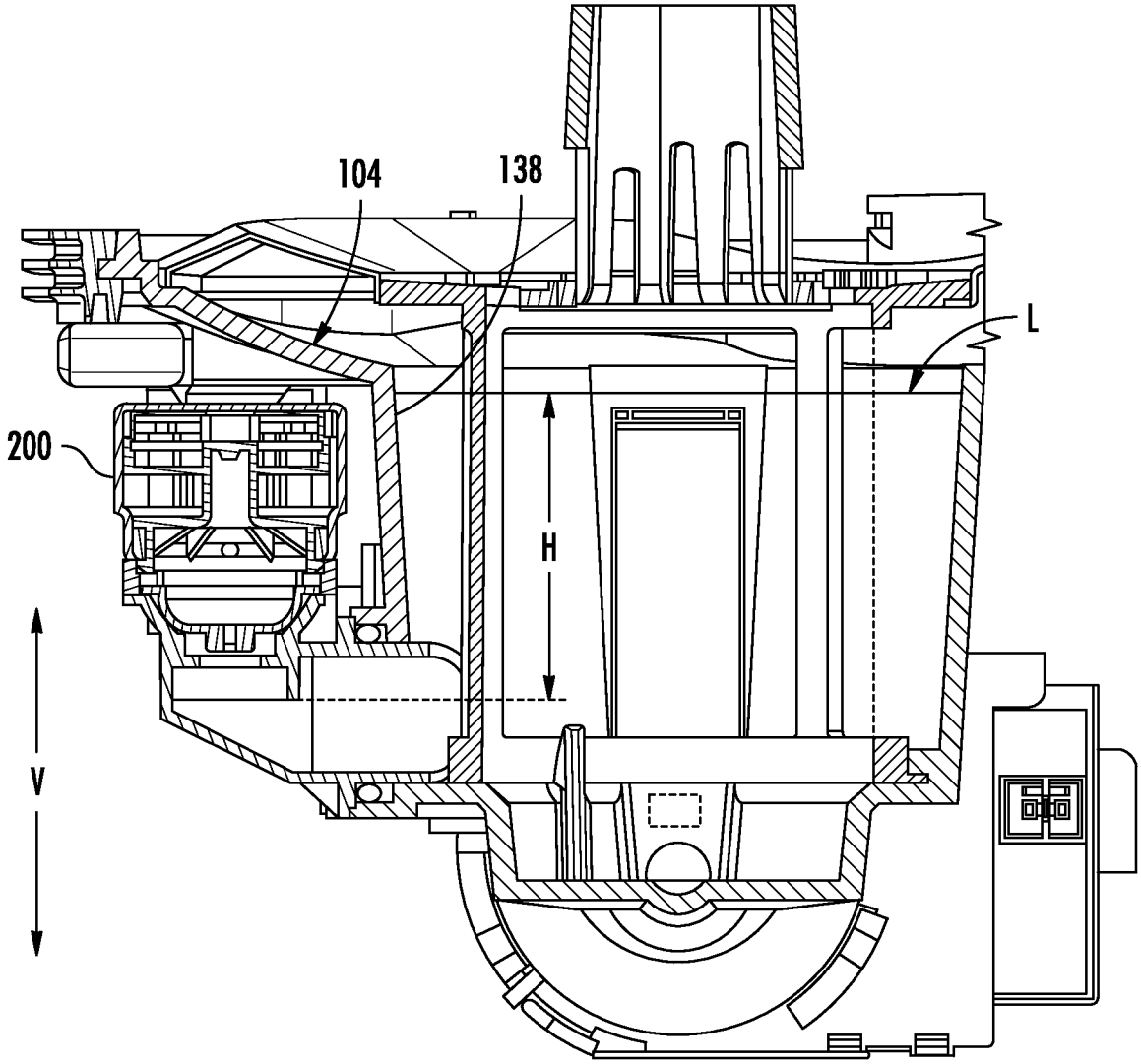
FIG. 3 provides a close up, cross sectional view of a sump and a pressure sensor of the dishwashing appliance of FIGS. 1 and 2.

FIG. 3 provides a close up, cross sectional view of sump 138 and pressure sensor 200 mounted thereto of the dishwasher 100 of FIGS. 1 and 2. As noted above, pressure sensor 200 is operatively configured to detect a liquid level L within sump 138 or tub 104 and then communicate the liquid level L to controller 160 or conditioning circuit 310 via one or more signals. Thus, pressure sensor 200 and controller 160 or conditioning circuit 310 may be communicatively coupled (i.e., in operative communication). Pressure sensor 200 can send signals to controller 160 as a frequency, as an analog signal, or in another suitable manner. Pressure sensor 200 can be any suitable type of sensor capable of sensing the liquid level L within dishwasher 100.

For the depicted embodiment of FIG. 3, pressure sensor 200 is configured to sense the height H of the water above pressure sensor 200 along the vertical direction V (e.g., by measuring the pressure on pressure sensor 200). In particular, for this embodiment, pressure sensor 200 includes a pressure plate that is acted on by the pressure of the wash fluid within sump 138. As the liquid level L rises, the pressure plate is pushed upward along the vertical direction V and thus compresses air trapped within the housing and a diaphragm of pressure sensor 200, which causes the diaphragm to flex or alter its position. As a result of the pressure and consequent movement of the diaphragm, a permanent magnet attached to the diaphragm may change its position in relation to a Hall-effect transducer. The transducer delivers one or more electrical signals proportional to the magnetic field of the magnet. The signals may be linearized, digitized, or amplified before being sent to controller 160 for processing. The pressure sensor 200 may include a printed circuit board (PCB) board to electrically connect the various electrical components. As noted above, other types of pressure sensors are contemplated.

Figure 4:
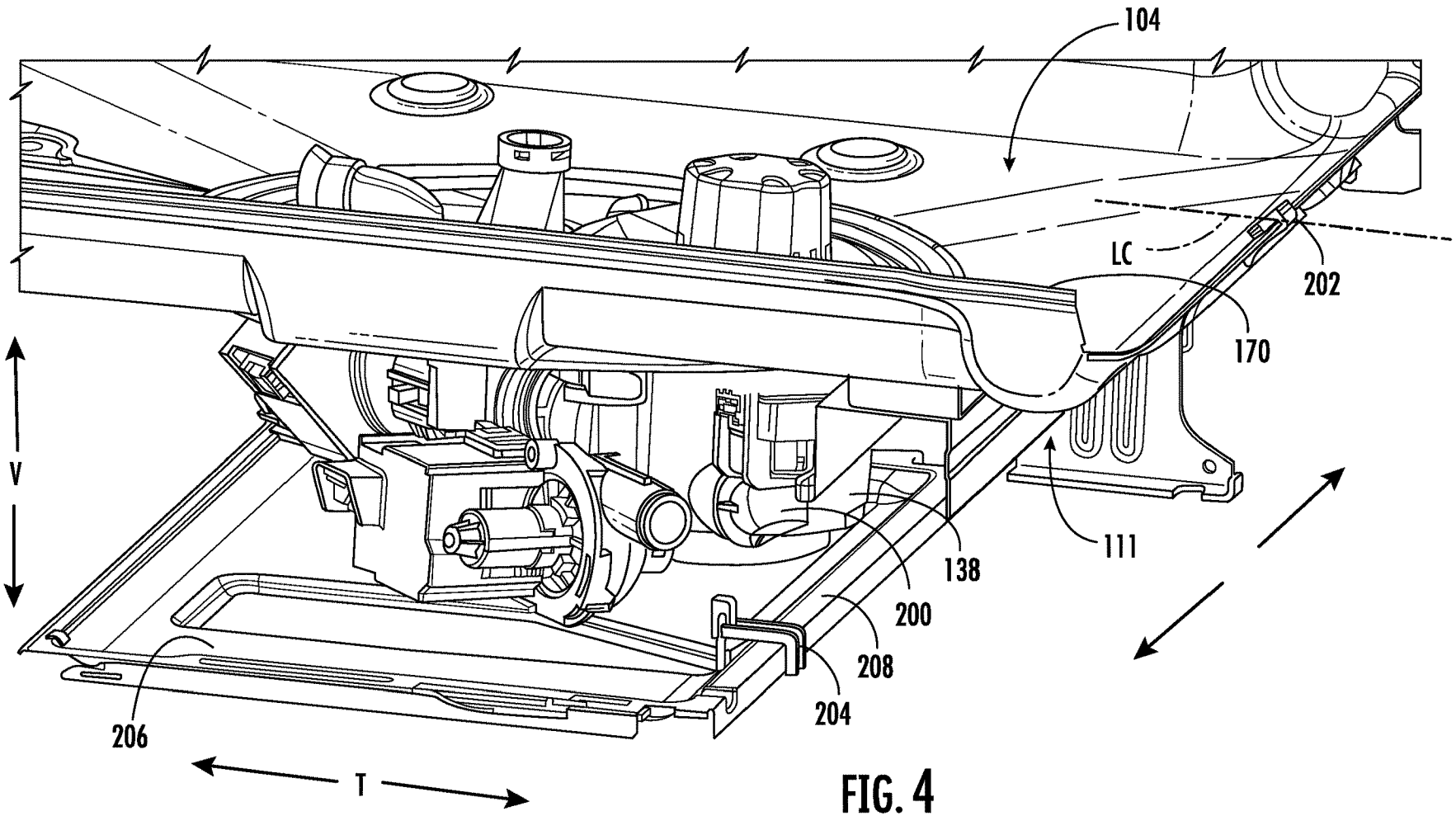
FIG. 4 provides a perspective view of an exemplary tub lip sensor coupled with a tub lip of a tub of the dishwasher appliance of FIGS. 1 and 2 and a leak pan sensor coupled with a leak pan of the dishwasher appliance.

FIG. 4 provides a perspective view of tub lip sensor 202 coupled with or attached to tub lip 170 of tub 104 and leak pan sensor 204 coupled with or attached to leak pan 206 of the dishwasher appliance 100 of FIGS. 1 and 2. As noted above, tub lip sensor 202 is operatively configured to detect high water or wash fluid levels within tub 104, and more particularly, tub lip sensor 202 is configured to sense wash fluid that is at or proximate tub lip 170. Tub lip sensor 202 is communicatively coupled with controller 160 or conditioning circuit 310 and may communicate therewith via one or more signals.

For the depicted embodiment of FIG. 4, a tub lip sensor 202 is positioned on or mounted to tub lip 170 of tub 104, and more particularly, tub lip sensor 202 is positioned on or mounted to tub lip 170 at front side 111 of tub 104 for this embodiment. By positioning tub lip sensor 202 at or on tub lip 170, tub lip sensor 202 does not interfere with the water flow through sump 138 during wash or drain cycles and takes up a minimal amount of space (e.g., compared to float sensors). In addition, by placing tub lip sensor 202 at front side 111 of tub 104, tub lip sensor 202 is advantageously positioned to detect water spillage or floods over the front portion of tub 104, which is a location where water is likely to spill or flood onto the floor of a consumer's home in the event of a water breach over this portion of tub 104. Further, for this embodiment, tub lip sensor 202 is positioned approximately along a lateral centerline LC that extends along the transverse direction T midway along the lateral length of tub 104. In this way, tub lip sensor 170 may still detect high wash fluid levels during out-of-level conditions (e.g., tilting of the dishwasher 100 about the transverse direction T).

In the depicted embodiment of FIG. 4, tub lip sensor 202 is a conductivity sensor. That is, when water or wash fluid fills up to tub lip 170, the wash fluid bridges leads or electrical contacts of tub lip sensor 202, thus allowing an electrical current to travel from one lead to the other. This completes a circuit that includes the electrical leads of tub lip sensor 202 and controller 160 or conditioning circuit 310, among other possible electrical components. The change or increase in electrical current through the circuit is indicative that wash fluid is present or sensed at tub lip 170. Optionally, the change in electrical current through the circuit can be measured by any suitable parameter (e.g., a change in current, voltage, or resistance) and by any suitable device (e.g., a multimeter positioned within controller 160).

As further provided in FIG. 4, as noted above, leak pan senor 204 is operatively configured to detect wash fluid in leak pan 206. Moreover, for this embodiment, leak pan sensor 204 is configured to sense wash fluid that is a predetermined distance from a pan lip 208 of leak pan 206. Leak pan sensor 204 is communicatively coupled with controller 160 or conditioning circuit 310 and may communicate therewith via one or more signals.

In the depicted embodiment of FIG. 4, leak pan sensor 204 is a conductivity sensor. That is, when water or wash fluid fills to the predetermined distance from the pan lip 208 of leak pan 206, the wash fluid bridges leads or electrical contacts of leak pan sensor 204, thus allowing an electrical current to travel from one lead to the other. This completes a circuit that includes the electrical leads of leak pan sensor 204 and controller 160, among other possible electrical components. The change or increase in electrical current through the circuit is indicative that wash fluid is present or sensed within leak pan 206, and more particularly, the increase in electrical current between the leads of leak pan sensor 204 is indicative of wash fluid being present at a predetermined distance from pan lip 208.

In optional embodiments, the leak pan sensor 204 is electrically connected in parallel with tub lip sensor 202. By electrically connecting leak pan sensor 204 in parallel with tub lip sensor 202, wiring costs of dishwasher 100 may be reduced, among other benefits.

Figure 5:
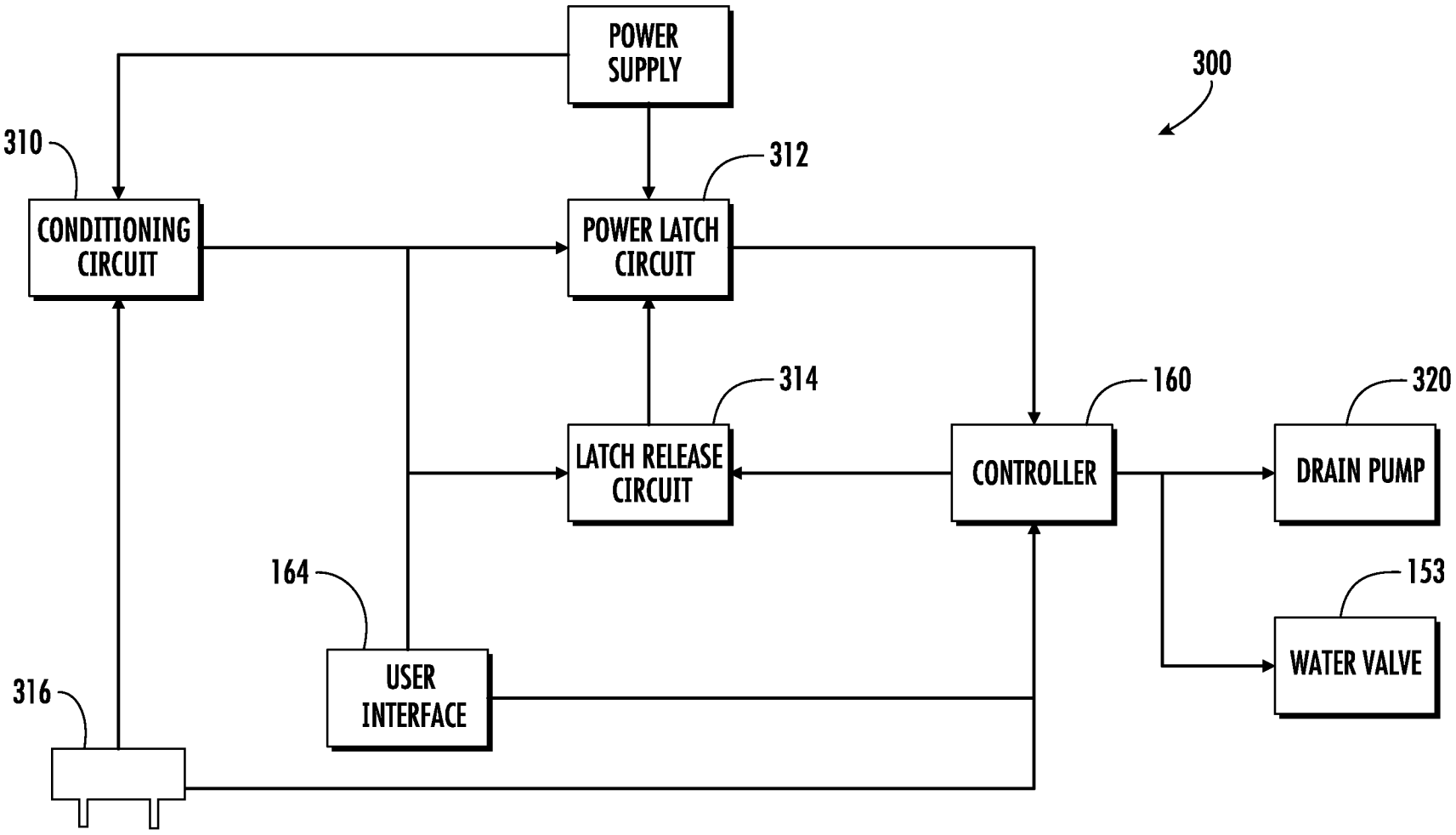
FIG. 5 provides a schematic view of various operational elements of a dishwashing appliance according to certain exemplary embodiments of the present disclosure.
Figure 6:
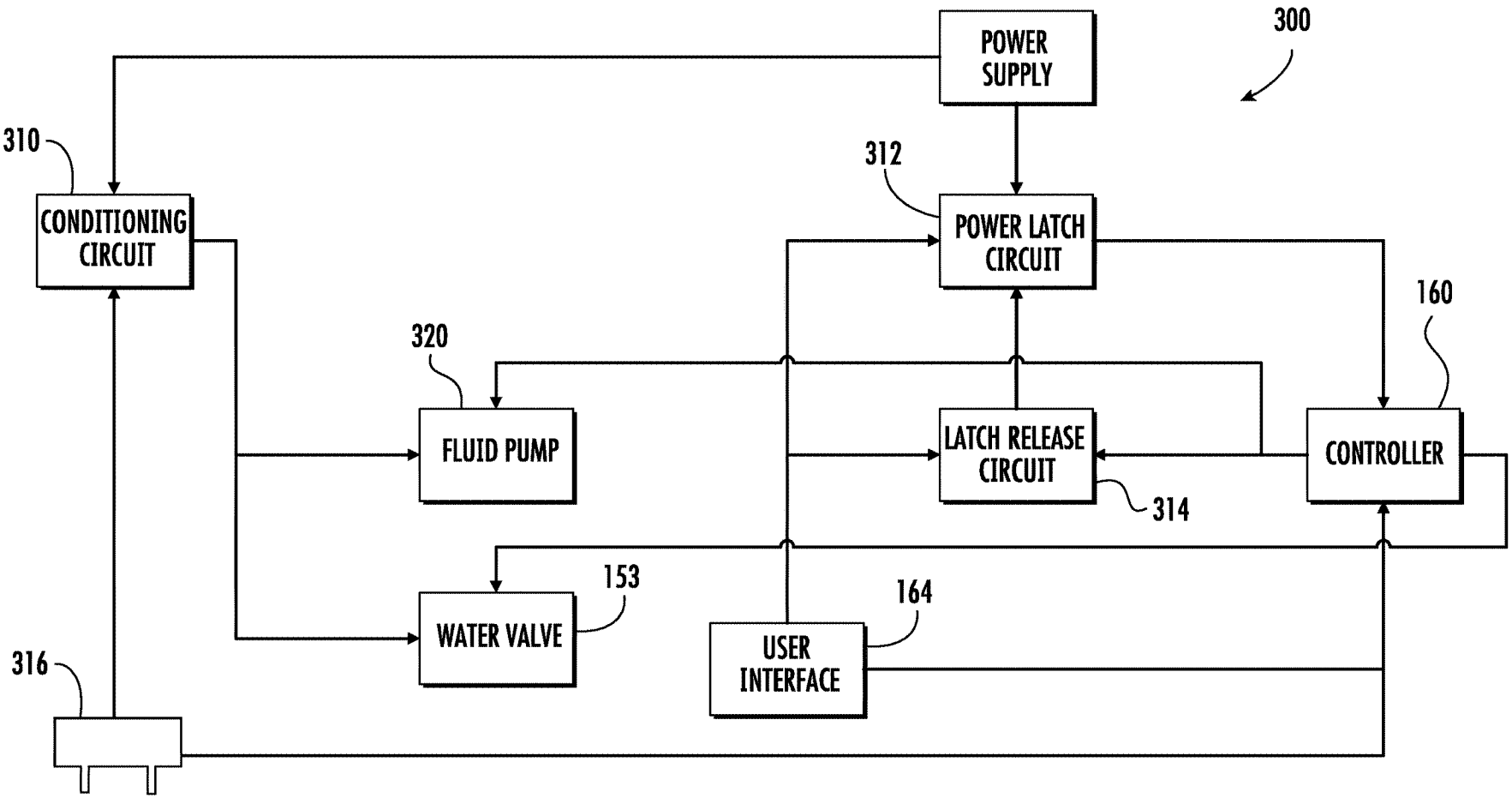
FIG. 6 provides a schematic view of various operational elements of a dishwashing appliance according to other exemplary embodiments of the present disclosure.
Figure 7:
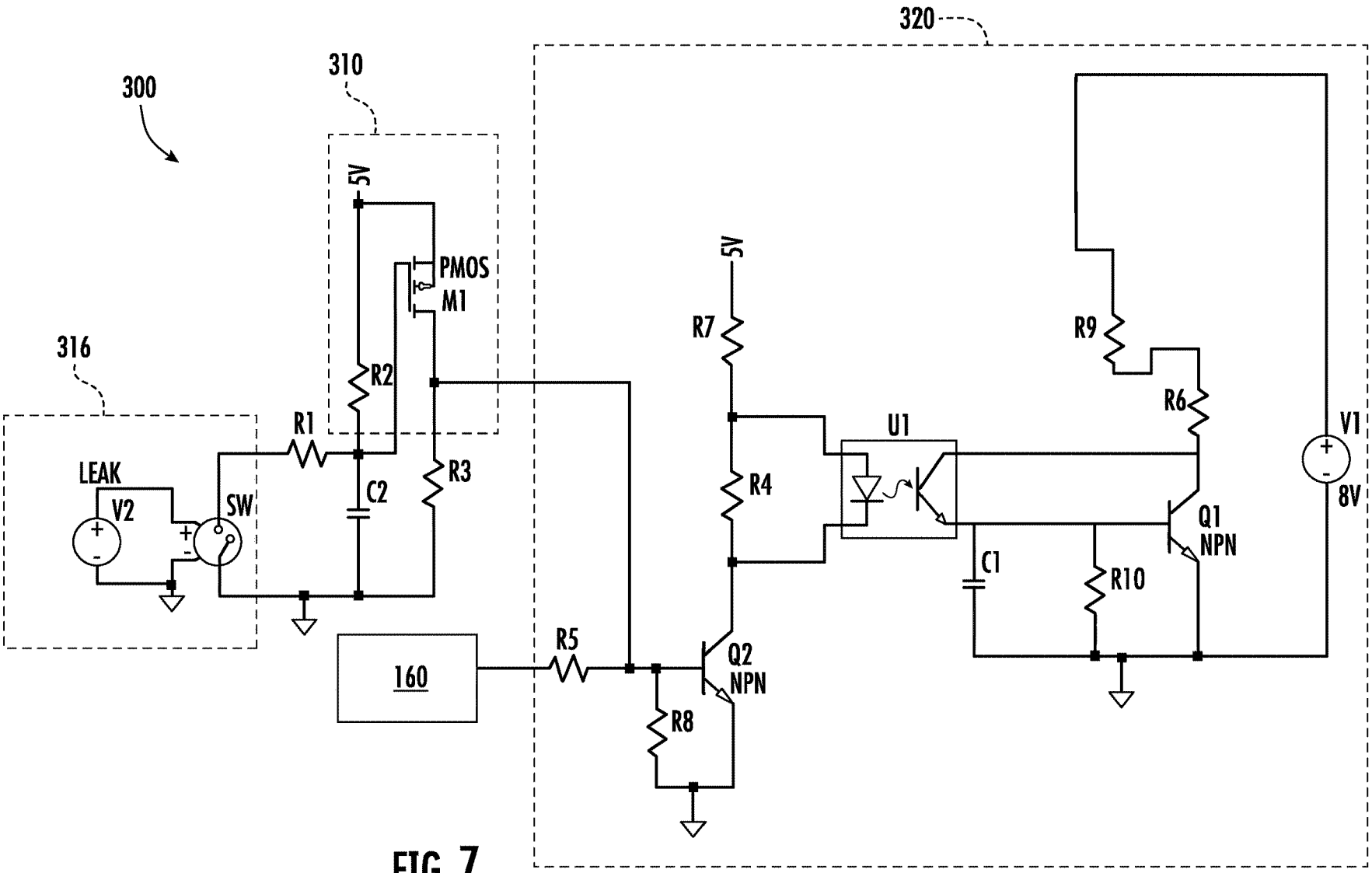
FIG. 7 provides another schematic view, including a circuit, of various operational elements of a dishwashing appliance according to other exemplary embodiments of the present disclosure.

Turning generally to FIGS. 5 through 7, and as noted above, a conditioning circuit 310 that is separate from the controller 160 may be provided as part of a larger operational assembly 300. For instance, the conditioning circuit 310 may be provided in electrical communication with a low-power input sensor 316 and configured to receive one or more fluid0loss signals from the same (e.g., apart from the controller 160). Generally, the conditioning circuit 310 is also in electrical communication with a power source and may be configured to receive continuous power therefrom (e.g., even when controller 160 is in a standby operational mode or irrespective of the operational mode of the controller 160).

As would be understood in light of the present disclosure, multiple electrical components may be included with or as part of conditioning circuit 310 (e.g., resistors, switches, transistors, relays, etc.) and may configured to conditionally or selectively close an electrical path through the circuit based on one or more received signals (e.g., from the low-power input sensor 316). In turn, a mitigation action may be prompted or initiated to address a detected or potential fluid-loss event. Thus, conditioning circuit 310 may be configured to receive the fluid-loss signal and initiate a mitigation action in response to receiving the fluid-loss signal (e.g., apart from the controller 160 at the standby mode).

As also noted above, the controller 160 may be configured to alternate between an active operational mode and a standby operational mode. In some embodiments, a power latch circuit 312 or a latch release circuit 314 may be provided (e.g., in electrical communication with controller 160) to effectuate alternation between such active and standby operational modes. For instance, in the active operational mode, power (e.g., an electrical current from the power source) may be permitted to the controller 160 through a closed power latch circuit 312. As shown, the power latch circuit 312 may be in electrical communication with the conditioning circuit 310 or latch release circuit 314. In some embodiments, the conditioning circuit 310 is configured to close the power latch circuit 312 (e.g., in response to a received fluid-loss signal from the low-power input sensor 316 or as part of a mitigation action) and may, thus, direct the controller 160 to the active operational state from the standby state. In additional or alternative embodiments, the latch release circuit 314 is configured to open the power latch circuit 312 (e.g., in response to a received signal from the controller 160, such as might be prompted by a determined standby condition) and may, thus, direct the controller 160 to the standby operational state from the active operational state.

Turning especially to FIG. 5, in some embodiments, the conditioning circuit 310 is directly connected to the low-power input sensor 316 and indirectly connected to one or more operational components (e.g., fluid pump 320 or water valve 153) of the dishwasher 100. For instance, the conditioning circuit 310 may be in electrical communication with the controller 160 (e.g., via the power latch circuit 312) and configured to send one or more signals thereto. The controller 160 may be in (e.g., direct) electrical communication with one or more water-flow components (e.g., the fluid pump 320 or water valve 153).

In response to receiving a fluid-loss signal from the low-power input sensor 316 (e.g., as described above) at or while the controller 160 is in the standby mode, the conditioning circuit 310 may be configured to initiate a mitigation action. Specifically, a responsive signal or voltage may be transmitted from the conditioning circuit 310 to the power latch circuit 312 in response to the received fluid-loss signal. The responsive signal or voltage may close the power latch circuit 312, which may subsequently direct power to the controller 160 (e.g., thereby alternating the controller 160 to the active operational mode). Placing the controller 160 in the active operational mode may allow the controller 160 to determine the fluid-loss event (e.g., based on one or more signal received directly from the low-power input sensor 316 at the controller 160).

In certain embodiments, the mitigation action further includes directing activation of the fluid pump 320 (e.g., circulation pump 152 or drain pump 168—FIG. 2) from the controller 160 (e.g., in response to the determined fluid-loss event). Thus, the fluid pump 320 may be activated to pump water or wash fluid from the dishwasher 100 (e.g., to the drain conduit 167—FIG. 2). In additional or alternative embodiments, the mitigation action further includes directing the water valve 153 to a closed or restricted position from the controller 160 (e.g., in response to the determined fluid-loss event). Thus, the water valve 153 may limit or prevent the further flow of water to the dishwasher 100. In still further additional or alternative embodiments, the mitigation action further includes activating the user interface panel 164 (e.g., a display or visible element thereof) from the controller 160 (e.g., in response to the determined fluid-loss event). Thus, a user may be given a visual alert or indication of the fluid-loss event at the user interface panel 164. As would be understood, an optional signal may be transmitted to a remote device (e.g., as a push alert prompted by the controller 160) to notify the user of the detected or potential fluid-loss event.

Turning especially to FIGS. 6 and 7, in some embodiments, the conditioning circuit 310 is directly connected to the low-power input sensor 316 and to one or more operational components (e.g., fluid pump 320 or water valve 153) of the dishwasher 100. For instance, the conditioning circuit 310 may be in electrical communication with the controller 160 (e.g., via the power latch circuit 312) and separately in direct electrical communication with one or more water-flow components (e.g., the fluid pump 320 or water valve 153).

In response to receiving a fluid-loss signal from the low-power input sensor 316 (e.g., as described above) at or while the controller 160 is in the standby mode, the conditioning circuit 310 may be configured to initiate a mitigation action, which may be irrespective of the operational mode of the controller 160. Specifically, a responsive signal or voltage may be transmitted from the conditioning circuit 310 to a water-flow component, thereby directing activation of the water-flow component in response to the received fluid-loss signal. Optionally, a responsive signal or voltage may be transmitted from the conditioning circuit 310 to power latch circuit 312 in response to the received fluid-loss signal.

The responsive signal or voltage may prompt activation of the fluid pump 320 (e.g., circulation pump 152 or drain pump 168—FIG. 2), closing of the water valve 153, or close the power latch circuit 312, which may subsequently direct power to the controller 160 (e.g., thereby alternating the controller 160 to the active operational mode). Placing the controller 160 in the active operational mode may allow the controller 160 to determine the fluid-loss event (e.g., based on one or more signal received directly from the low-power input sensor 316 at the controller 160), separately from the fluid pump 320 or water valve 153.

In certain embodiments, the mitigation action further includes selectively directing power to the fluid pump 320 from the conditioning circuit 310 (e.g., in response to the determined fluid-loss event). Thus, the fluid pump 320 may be activated to pump water or wash fluid from the dishwasher 100 (e.g., to the drain conduit 167—FIG. 2). In additional or alternative embodiments, the mitigation action further includes directing the water valve 153 to a closed or restricted position from the conditioning circuit 310 (e.g., in response to the determined fluid-loss event). Thus, the water valve 153 may limit or prevent the further flow of water to the dishwasher 100.

In optional embodiments, the mitigation action further includes activating the user interface panel 164 (e.g., a display or visible element thereof) from the controller 160 (e.g., in response to the determined fluid-loss event). Thus, a user may be given a visual alert or indication of the fluid-loss event at the user interface panel 164. As would be understood, an optional signal may be transmitted to a remote device (e.g., as a push alert prompted by the controller 160) to notify the user of the detected or potential fluid-loss event.

Notably, the above-described embodiments may be capable of addressing potential leaks or flooding events of an appliance (e.g., outside of an active cycle or operation or even while a main controller is in an inactive or standby mode). Additionally or alternatively, the above described embodiments may advantageously mitigate address potential leaks or flooding events at a relatively low power draw or without significantly increasing energy use of the appliance (e.g., in comparison with existing appliances or systems).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet;

a tub positioned within the cabinet and defining a wash chamber for receipt of articles for washing;

a door mounted to the cabinet to selectively restrict access to the tub;

a spray assembly positioned within the wash chamber;

a fluid pump in fluid communication with the wash chamber;

a controller configured to alternate between an active operational mode and a standby mode in which a power draw at the controller is less than a power draw of the active operational mode;

a low-power input sensor configured to detect a fluid-loss event at the dishwashing appliance at the standby mode of the controller and transmit a fluid-loss signal in response to detecting the fluid-loss event; and a conditioning circuit attached to the cabinet in electrical communication with the low-power input sensor and separate from the controller, the conditioning circuit being configured to receive the fluid-loss signal apart from the controller at the standby mode and initiate a mitigation action in response to receiving the fluid-loss signal.

2. The dishwashing appliance of claim 1, wherein the low-power input sensor comprises a water sensor configured to detect water within the cabinet.

3. The dishwashing appliance of claim 2, wherein the water sensor comprises a continuity sensor, pressure sensor, or flowmeter.

4. The dishwashing appliance of claim 1, wherein the mitigation action comprises directing the controller to the active operational mode from the standby mode.

5. The dishwashing appliance of claim 4, wherein the controller is in operative communication with the fluid pump, and wherein the mitigation action further comprises directing activation of the fluid pump from the controller.

6. The dishwashing appliance of claim 4, further comprising a water valve in upstream fluid communication with the wash chamber and in operative communication with the controller, wherein the mitigation action further comprises directing the water valve to a closed position from the controller.

7. The dishwashing appliance of claim 4, further comprising a user interface panel mounted to the cabinet in operative communication with the controller, wherein the mitigation action further comprises activating the user interface panel from the controller.

8. The dishwashing appliance of claim 1, wherein the mitigation action comprises selectively directing power to the fluid pump from the conditioning circuit.

9. The dishwashing appliance of claim 1, further comprising a water valve in upstream fluid communication with the wash chamber and in electrical communication with the conditioning circuit, wherein the mitigation action further comprises directing the water valve to a closed position from the conditioning circuit.

10. A wash appliance, comprising:

a cabinet;

a tub positioned within the cabinet and defining a wash chamber for receipt of articles for washing;

a door mounted to the cabinet to selectively restrict access to the tub;

a fluid pump in fluid communication with the wash chamber, the fluid pump being a drain pump mounted within the cabinet downstream from the wash chamber;

a controller in operative communication with the fluid pump and configured to alternate between an active operational mode and a standby mode in which a power draw at the controller is less than a power draw of the active operational mode;

a low-power input sensor configured to detect a fluid-loss event at the wash appliance at the standby mode of the controller and transmit a fluid-loss signal in response to detecting the fluid-loss event; and a conditioning circuit attached to the cabinet in electrical communication with the low-power input sensor and the controller, the conditioning circuit being configured to receive the fluid-loss signal apart from the controller at the standby mode and initiate a mitigation action in response to receiving the fluid-loss signal, the mitigation action comprising directing the controller to the active operational mode from the standby mode.

11. The wash appliance of claim 10, wherein the low-power input sensor comprises a water sensor configured to detect water within the cabinet.

12. The wash appliance of claim 11, wherein the water sensor comprises a continuity sensor, pressure sensor, or flowmeter.

13. The wash appliance of claim 10, wherein the controller is in operative communication with the fluid pump, and wherein the mitigation action further comprises directing activation of the fluid pump from the controller.

14. The wash appliance of claim 10, further comprising a water valve in upstream fluid communication with the wash chamber and in operative communication with the controller, wherein the mitigation action further comprises directing the water valve to a closed position from the controller.

15. The wash appliance of claim 10, further comprising a user interface panel mounted to the cabinet in operative communication with the controller, wherein the mitigation action further comprises activating the user interface panel from the controller.

16. A wash appliance, comprising:

a cabinet;

a tub positioned within the cabinet and defining a wash chamber for receipt of articles for washing;

a door mounted to the cabinet to selectively restrict access to the tub;

a fluid pump in fluid communication with the wash chamber, the fluid pump being a drain pump mounted within the cabinet downstream from the wash chamber;

a controller configured to alternate between an active operational mode and a standby mode in which a power draw at the controller is less than a power draw of the active operational mode;

a low-power input sensor configured to detect a fluid-loss event at the wash appliance at the standby mode of the controller and transmit a fluid-loss signal in response to detecting the fluid-loss event; and a conditioning circuit attached to the cabinet in electrical communication with the low-power input sensor and the controller, the conditioning circuit being configured to receive the fluid-loss signal apart from the controller at the standby mode and initiate a mitigation action in response to receiving the fluid-loss signal, the mitigation action comprising directing activation of a water-flow component within the cabinet apart from the controller.

17. The wash appliance of claim 16, wherein the low-power input sensor comprises a water sensor configured to detect water within the cabinet.

18. The wash appliance of claim 17, wherein the water sensor comprises a continuity sensor, pressure sensor, or flowmeter.

19. The wash appliance of claim 16, wherein the water-flow component comprises the fluid pump, and wherein the mitigation action comprises selectively directing power to the fluid pump from the conditioning circuit.

20. The wash appliance of claim 16, further comprising a water valve in upstream fluid communication with the wash chamber and in electrical communication with the conditioning circuit, wherein the water-flow component comprises the water valve, and wherein the mitigation action further comprises directing the water valve to a closed position from the conditioning circuit.

* * * * *